US009397408B2

(12) United States Patent
Sabielny

(10) Patent No.: US 9,397,408 B2
(45) Date of Patent: Jul. 19, 2016

(54) ANTENNA ARRAY

(75) Inventor: Michael Sabielny, Ulm (DE)

(73) Assignee: AIRBUS DEFENCE AND SPACE GMBH, Ottobrunn (DE)

( * ) Notice: Subject to any disclaimer, the term of this patent is extended or adjusted under 35 U.S.C. 154(b) by 206 days.

(21) Appl. No.: 13/365,620

(22) Filed: Feb. 3, 2012

(65) Prior Publication Data

US 2012/0200474 A1 Aug. 9, 2012

(30) Foreign Application Priority Data

Feb. 4, 2011 (EP) ..... 11000921

(51) Int. Cl.

| | |
|---|---|
| ***H01Q 21/00*** | (2006.01) |
| ***H01P 11/00*** | (2006.01) |
| ***H01Q 21/06*** | (2006.01) |
| ***H01Q 19/02*** | (2006.01) |

(52) U.S. Cl.
CPC ..... *H01Q 21/061* (2013.01); *H01Q 19/023* (2013.01); *Y10T 29/49016* (2015.01)

(58) Field of Classification Search
CPC ..... H01Q 21/061; H01Q 19/023
See application file for complete search history.

(56) References Cited

U.S. PATENT DOCUMENTS

| | | | |
|---|---|---|---|
| 3,605,098 | A | 9/1971 | Hannan |
| 7,580,003 | B1 | 8/2009 | Davis et al. |
| 2007/0241984 | A1 | 10/2007 | Schadler |

FOREIGN PATENT DOCUMENTS

| | | |
|---|---|---|
| JP | 2007-13311 | 1/2007 |

OTHER PUBLICATIONS

Daniel T. McGrath, "Accelerated Periodic Hybrid Finite Element Method Analysis for Integrated Array Element and Radome Design", Proceedings, International Conference on Phased Array Systems and Technology, XP010504600; ISBN: 978-0-7803-6345-8; pp. 319-322, May 21, 2000.

S.Sajuyigbe et al., "Wide angle impedance matching metamaterials for waveguide-fed phased-array antennas," IET Microwaves, Antennas & Propagation, Vo.. 4, Iss.8, XP-002639838, pp. 1063-1072, May 14, 2010.

E.Magill et al., "Wide-angle impedance matching of a planner array antenna by a dielectric shhet", IEEE Transactions on Antennas and Propagation, vol. 14, No. 1, pp. 49-53, 1966

*Primary Examiner* — Hoang V Nguyen
*Assistant Examiner* — Michael Bouizza
(74) *Attorney, Agent, or Firm* — Greenblum & Bernstein, P.L.C.

(57) ABSTRACT

An antenna array that includes a plurality of antenna elements and a method of forming an antenna array. The antenna array includes an antenna baseplate on which the plurality of antenna elements are arranged in a regular grid, and a dielectric wide angle impedance match (WAIM) layer structured and arranged in front of the antenna elements to match impedance for large skew angles. The WAIM layer includes a monolithic material layer from which spacers are machined in a regular grid that corresponds to the grid of the antenna elements.

24 Claims, 7 Drawing Sheets

ANTENNA ARRAY

CROSS-REFERENCE TO RELATED APPLICATIONS

The present application claims priority under 35 U.S.C. §119(a) of European Patent Application No. 11000921.4 filed Feb. 4, 2011, the disclosure of which is expressly incorporated by reference herein in its entirety.

BACKGROUND OF THE INVENTION

1. Field of the Invention

The embodiments of the invention relate to an antenna array having a WAIM layer for impedance matching for large skew angles. In particular, the antenna array includes an antenna baseplate having a plurality of antenna elements arranged in a regular grid and a dielectric wide angle impedance match (WAIM) layer arranged in front of the antenna elements for impedance matching for large skew angles.

2. Discussion of Background Information

One phenomenon that is often observed in the transmission behavior of an antenna array while the main beam is being electronically scanned is the difference in the transmission level depending on the direction to which the antenna is skewed. Normally, an antenna has a defined polarization alignment, for example vertical or horizontal polarization. In order to explain this phenomenon, it is sufficient to electronically skew the main beam of an antenna array in an imaginary form along two planes (vertical & horizontal). If the vector of the emitted electrical field strength is within the skew plane, defined as being formed from the skew direction and normal to the antenna, the term transverse magnetic polarization (TM) is used. If the vector of the electrical field strength is at right angles to this plane, the term transverse electrical (TE) is used. All other possible polarization states can be broken down into these two polarization components. In principle, conventional antenna arrays (as well as other structures of a related type such as dielectric or frequency-selective radomes) have a tendency to form a poorer transmission level in TE than in TM as the skew angle increases.

A so-called wide angle impedance match (WAIM) layer, which is arranged in front of the antenna elements, can counteract this effect. With respect to the two polarization cases of TE and TM, the WAIM layer acts analogously to an equivalent line model of the antenna as a parallel-connected capacitance, whose relative susceptance (with respect to the characteristic impedance) varies with the skew angle $\theta$. For the case of TE polarization, this change takes place with the factor $1/\cos(\theta)$, but with the factor $\cos(\theta)$ for the case of TM polarization, provided that the dielectric constant of the WAIM layer is sufficiently high, and the thickness of the WAIM layer is sufficiently thin. If the WAIM layer is suitably designed, the described reciprocity of the factors now leads to the transmission levels of the antenna being matched to one another, between TE and TM polarization, during skewing. This applies to all possible skew angles within a technical sensible range from, for example, $\theta=0°$ to $\theta=60°$. This matching then results in the normally desired broad individual polar diagrams of antenna elements of an antenna array in all the important section levels.

The solutions used until now have been based essentially on the theoretical works by Magill & Wheeler (E. Magill and H. Wheeler, "Wide-angle impedance matching of a planar array antenna by a dielectric sheet," IEEE Transactions on Antennas and Propagation, Vol. 14, No. 1, pages 49-53, 1966), the disclosure of which is expressly incorporated by reference herein in its entirety. A WAIM layer carries out the purpose of transmission matching between TE and TM polarization only if it is kept at a short but well-defined distance from the antenna elements in the antenna array.

The standard solution for production of the necessary physical separation is the use of RF foam materials, as described, e.g., in U.S. Pat. No. 7,580,003 B1, the disclosure of which is expressly incorporated by reference herein in its entirety. While the availability of foams such as these does not represent a problem, a range of disadvantages occur in the course of use of such foams:

- Hygroscopy: many foams have a tendency to absorb moisture from the environment over time, and this leads to a major change in the dielectric characteristics. The consequence of this is complex measures for encapsulation of the foam layer.
- Tolerances: foam layers with a thickness of a few millimeters can be produced only in a moderate tolerance band.
- Adhesive bonding: in principle, suitable standard materials for the WAIM layer (commercially available RF printed circuit board materials with a high dielectric constant, e.g., Rogers RT/duroid 6010) contain polytetrafluoroethylene (Teflon), which represents a problem in terms of long-lasting and reliable adhesive bonding to the foam material. It is admittedly in principle technically feasible to produce such adhesive bonds, but only with complex measures such as plasma activation of the WAIM components which contain Teflon.

U.S. Pat. No. 3,605,098, the disclosure of which is expressly incorporated by reference herein in its entirety, describes an antenna array in which there is a separate WAIM element in front of each antenna element. A WAIM element such as this in each case includes a WAIM layer parallel to the plane of the antenna elements, as well as spacers on which the WAIM layer is arranged.

MCGRATH D T: "Accelerated periodic hybrid finite element method analysis for integrated array element and radome design, PHASED ARRAY SYSTEMS AND TECHNOLOGY, 2000. PROCEEDINGS. 2000 IEEE INTERNATIONAL CONFERENCE ON DANA POINT, CA, USA 21-25 MAY 2000, PISCATAWAY, NJ, USA, IEEE, US, 21 May 2000 (21 May 2000), pages 319-322, XP010504600, DOI: DO1: 10.1109/PAST.2000.858965, ISBN: 978-0-7803-6345-8 describes an antenna array having waveguide antenna elements, with the waveguide antenna elements having dielectric filling elements in order to specifically vary the radiation characteristics of the antenna. The dielectric filling elements project out of the antenna. A WAIM layer is arranged on these projecting dielectric filling elements. The disclosure of this document is expressly incorporated by reference herein in its entirety

SUMMARY OF THE EMBODIMENTS

Embodiments of the invention provides an antenna array with a WAIM layer that avoids the disadvantages that occur when using foams as an intermediate layer between the antenna elements and the WAIM layer.

Accordingly, the WAIM layer is a monolithic layer that covers all the antenna elements and has spacers machined out of its material in a regular grid. The grid of the spacers corresponding to the grid of the antenna elements.

According to embodiments of the invention, spacers are machined in a regular grid from the material of the WAIM layer. The spacers and the WAIM layer are therefore integrally (monolithically) connected to one another, with the grid of the spacers corresponding to the grid of the antenna elements. By way of example, the grid may be square, rectangular or hexagonal. In particular, the spacers may be in the form of columns with a round cross section. The WAIM layer is advantageously attached to the antenna baseplate on the spacers by mechanical connection (e.g., screws), with the numbers of such spacers where a connection is provided being dependent on the specific requirements. In particular, there is therefore no need to provide a connection on each spacer.

Therefore, according to embodiments, only the material of the WAIM layer, in which the spacers have already been integrated, is used, rather than the known multilayer structure of WAIM layer/adhesive film/foam, which comprise different materials. The spacers provide an air-filled or vacuum-filled separator between the WAIM layer and the antenna elements. The described disadvantages resulting from the previously used foams may be completely avoided. Furthermore, there is no need for complex adhesive-bonding processes for connection of the WAIM layer to a foam separator.

The spacers provide the WAIM layer with the required mechanical robustness. The layer is therefore insensitive to vibration, shock etc., and is therefore also suitable for robust application scenarios.

Since the grid in which the spacers are arranged corresponds to the grid of the antenna elements, the natural periodicity of the antenna array is not disturbed. As a result, no Bragg reflections can occur on the antenna surface within the frequency range for which the antenna array is designed. No losses need be accepted in the radar back-scattering cross section. Provided that there are no more stringent requirements for the radar back-scattering cross section (RCS), embodiments are alternatively also possible in which the grid of the spacers and the grid of the antenna elements do not correspond. This modified grid must, however, still be oriented with the grid of the antenna elements. For this purpose, the grid of the spacers is derived from the grid of the antenna elements such that there is a corresponding spacer only for every n-th antenna element (and there are no further spacers apart from these). This therefore represents a defined thinning out of the original grid of the spacers. In other words, the fundamental grid structure is maintained, but the grid size (grid constant) is changed by the factor n. In this case, n is a natural number greater than 1.

The described form of the WAIM layer may be achieved in particular by mechanical machining techniques, for example, milling out. Corresponding to its function as a WAIM layer, the material should have as high a dielectric constant as possible and a low loss angle, and its layer thickness should be as thin as possible. Dielectric materials such as these are commercially available as semi-finished products.

One suitable material for the WAIM layer is, for example, the dielectric material (product)"C-Stock AK" from Cuming Microwave Corporation, which is available with a customer-specific dielectric constant and in various semi-finished product sizes. Materials such as these can easily be processed using mechanical devices or processes (for example milling).

In order to provide more mechanical robustness, additional stiffening structures in the form of ribs may be formed from the material of the WAIM layer. In order to prevent these from having any negative effects on the transmission level of the antenna during electronic skewing, these structures must also follow the periodicity in the arrangement of the antenna elements. The ribs are designed such that they each connect two adjacent spacers.

The WAIM layer need not necessarily be planar. It may also have a one-dimensionally or two-dimensionally curved surface, for use with curved antenna arrays which are conformal with a structure.

The WAIM layer may be extended to form a multilayer WAIM block, by connection to further dielectric layers.

Embodiments of the invention are directed to an antenna array that includes a plurality of antenna elements, an antenna baseplate on which the plurality of antenna elements are arranged in a regular grid, and a dielectric wide angle impedance match (WAIM) layer structured and arranged in front of the antenna elements to match impedance for large skew angles. The WAIM layer includes a monolithic material layer from which spacers are machined in a regular grid that corresponds to the grid of the antenna elements.

According to embodiments, the grid of the antenna elements may be one of square, rectangular or hexagonal.

In accordance with other embodiments, the grid of the spacers may not be the same as the grid of the antenna elements. The grid of the spacers may be derived from the grid of the antenna elements such that there is a corresponding spacer only for every n-th antenna element, where n=2, 3, 4, . . . .

According to still other embodiments, reinforcing ribs can be machined from the WAIM layer so that each reinforcing rib connects two adjacent spacers.

In accordance with still other embodiments, the plurality of spacers can be attached to the antenna baseplate by mechanical connectors. The mechanical connectors may be arranged in a grid that corresponds to the grid of the spacers. The grid of the mechanical connectors may not be the same as the grid of the spacers. The grid of the mechanical connectors can be derived from the grid of the spacers so that a corresponding mechanical connector is provided only for every n-th spacer, where n=2, 3, 4, . . . .

According to other embodiments, the spacers can have a round cross-section.

Embodiments of the instant invention are directed to a method for forming an antenna array. The method includes arranging a plurality of antenna elements on an antenna backplate in an antenna element grid, forming a dielectric wide angle impedance match (WAIM) layer by forming a plurality of spacers from a monolithic material layer, the plurality of spacers being arranged in a regular grid corresponding to the antenna element grid, and positioning the WAIM layer in front of the antenna elements to match impedance for large skew angles.

In accordance with embodiments, the grid formed by the plurality of antenna elements may be one of square, rectangular or hexagonal.

According to other embodiments of the invention, the grid of the spacers may not be the same as the grid of the antenna elements. The grid of the spacers can be derived from the grid of the antenna elements such that there is a corresponding spacer only for every nth antenna element, where n=2, 3, 4, . . . .

In accordance with still other embodiments, the method can also include machining reinforcing ribs in the WAIM layer so that each reinforcing rib connects two adjacent spacers.

According to further embodiments, the method can also include attaching the plurality of spacers to the antenna baseplate with mechanical connectors. The mechanical connectors can be arranged in a grid that corresponds to the grid of the spacers. The grid of the mechanical connectors may not be the same as the grid of the spacers. The grid of the mechanical connectors can be derived from the grid of the spacers so that a corresponding mechanical connector is provided only for every n-th spacer, where n=2, 3, 4, . . . .

In accordance with still yet other embodiments of the present invention, the spacers may be formed to have a round cross-section.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein:

FIG. 2(*b*) illustrates a cross-sectional illustration of a WAIM layer attached to the antenna array from the rear;

FIG. 2(*c*) illustrates a cross-sectional illustration of a WAIM layer attached to the antenna array from the front;

FIG. 3(*b*) illustrates a WAIM layer (in transparent form) arranged in front of the antenna baseplate; and FIG. 3(*c*) illustrates a WAIM layer according to embodiments of the invention.

DETAILED DESCRIPTION OF THE EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
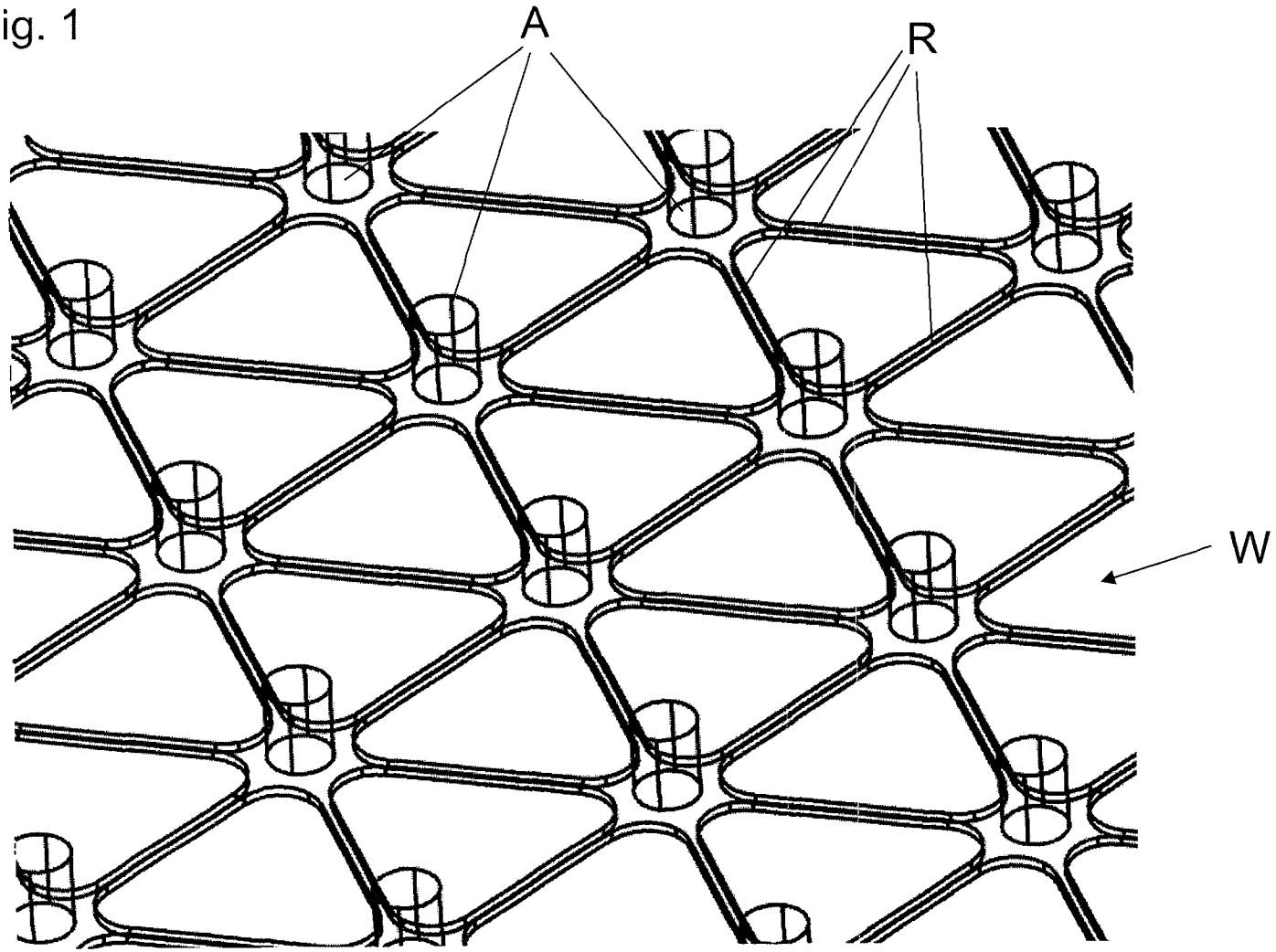
FIG. 1 illustrates a perspective view of a WAIM layer with periodically arranged spacer according to embodiments of the invention.

FIG. 1 illustrates an embodiment of the WAIM layer W according to the invention. Layer W is itself illustrated in a transparent form (lying in the plane of the paper). Spacers A, which in this embodiment, are in the form of posts (with circular cross sections) and reinforcing ribs R, which connect to at least one spacer A, can be understood to project out of layer W. According to embodiments, spacers A and reinforcing ribs R can be produced by being milling out from a material block, e.g., a monolithic block.

Figure 2A:
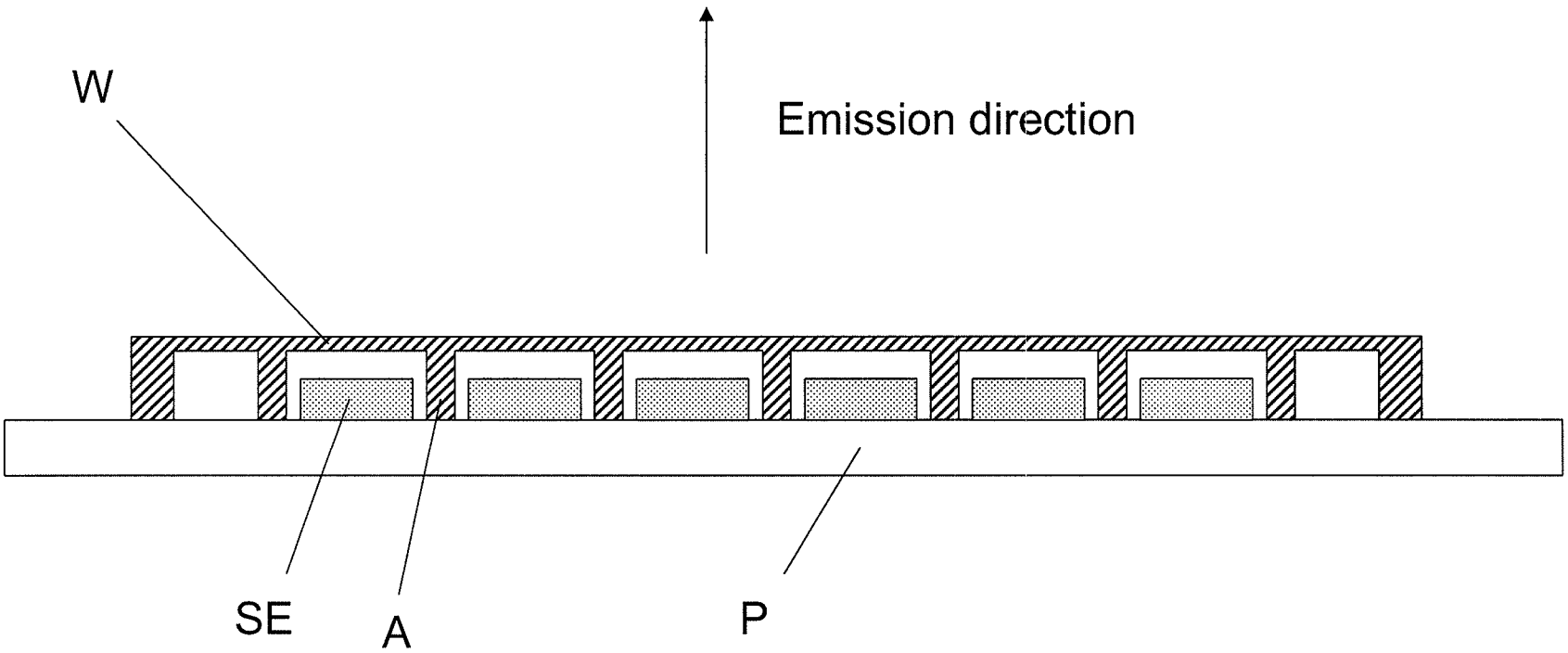
FIG. 2(*a*) illustrates a cross-sectional illustration of an antenna array and the WAIM layer.
Figure 2B:
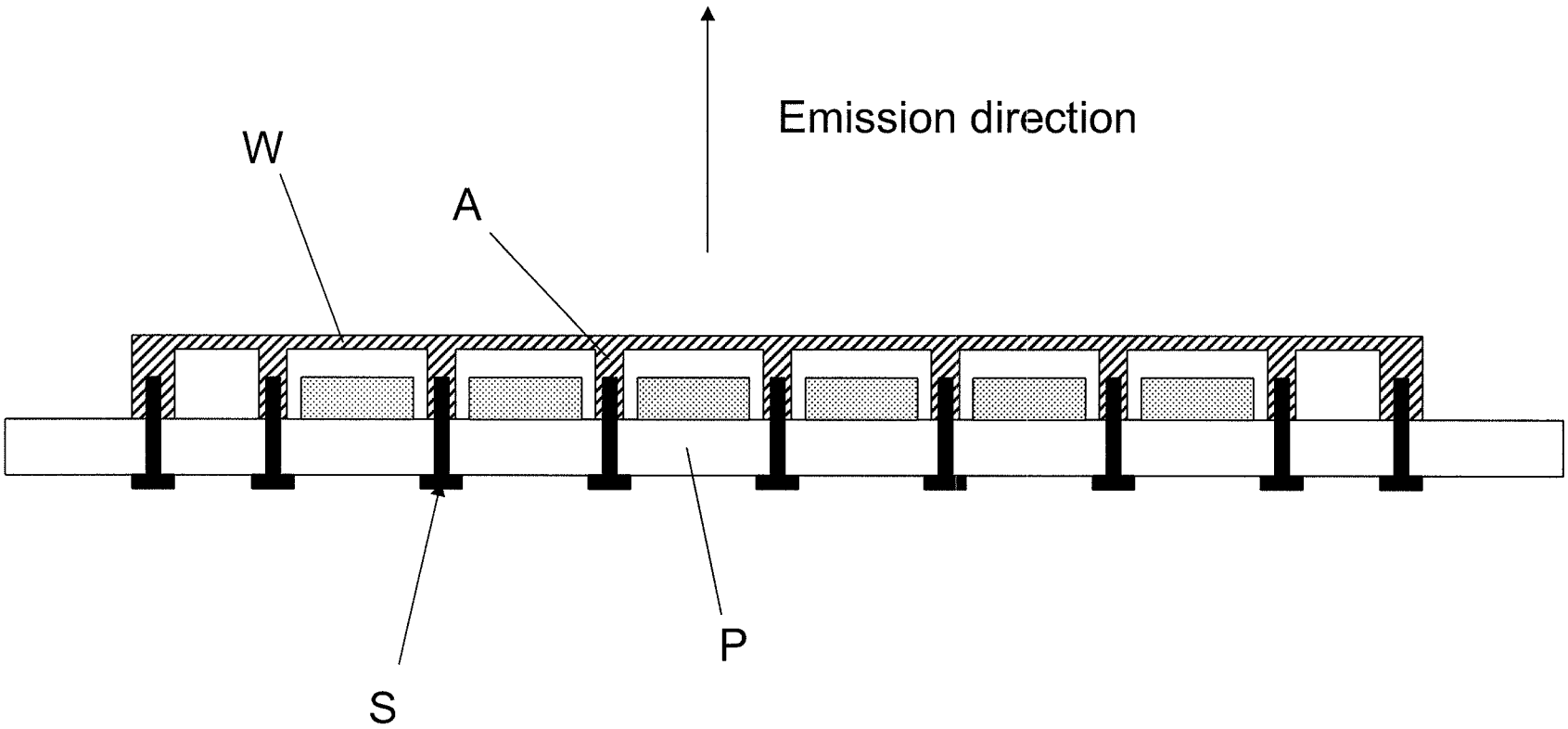
Figure 2C:
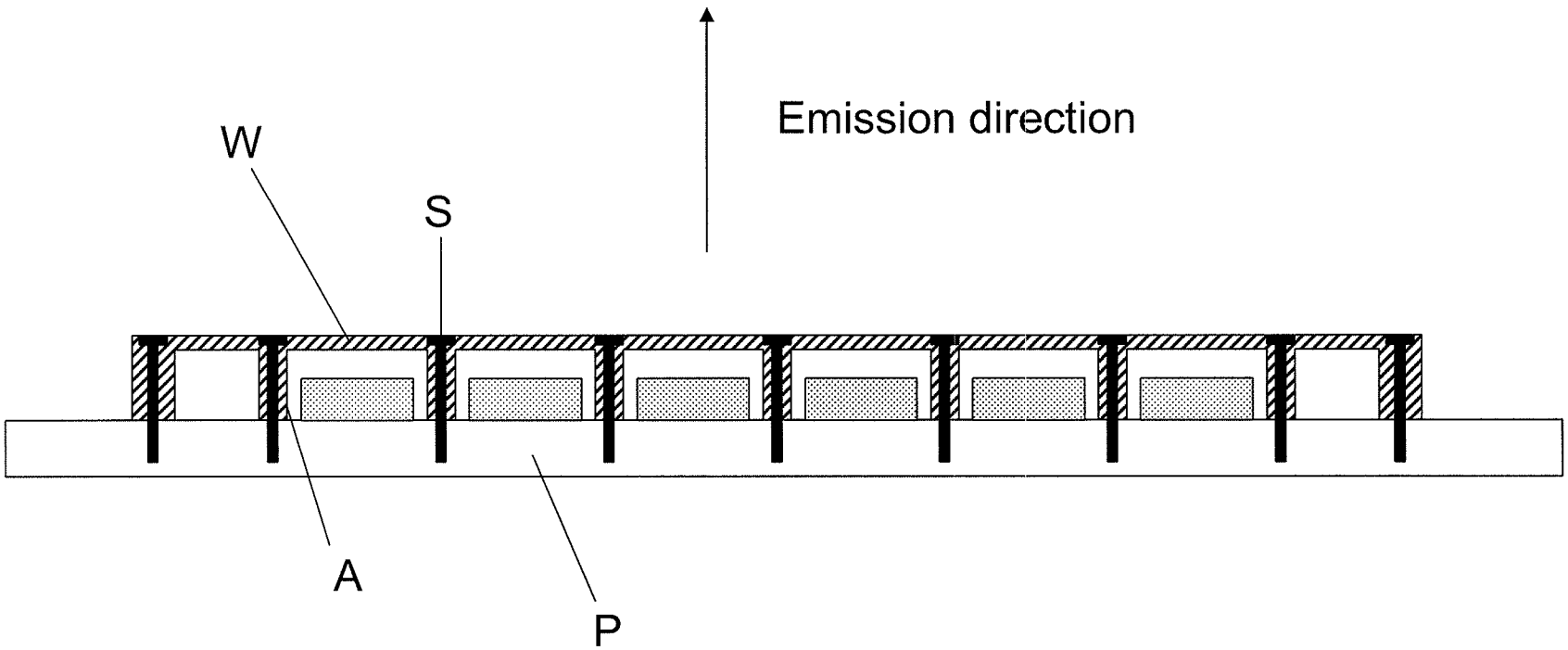

FIG. 2 shows cross-sectional illustrations of an antenna array according to the invention with a WAIM layer W arranged in front. The terms "in front" and "behind" with respect to the antenna are used in the sense that "in front" means the side of the antenna in which the emission takes place.

As illustrated spacers A are arranged in a regular grid to be positioned in the intermediate spaces between individual antenna elements SE and to abut antenna baseplate P, which is formed by a metallic material.

WAIM layer W is attached to metallic antenna baseplate P of the antenna array by a multiplicity of screws S (FIGS. 2(*b*) and 2(*c*)), which are screwed in the area of the spacers A. Screws S are preferably formed of a plastic material in this case, in order not to influence the antenna polar diagram. In their totality, screws S ensure that WAIM layer W is anchored in a very robust manner on baseplate P. The material characteristics of the screws should advantageously be as similar as possible to those of WAIM layer.

The number and position of the individual screws are chosen depending on the antenna robustness requirements. In particular, there is no need to provide a screw on every spacer.

However, in order to influence the antenna polar diagram as little as possible, the same grid as the grid predetermined by the antenna elements is chosen for the arrangement of the screws.

However, if the number of screws required is chosen to be less than the number of spacers A, the arrangement of the screws S is still oriented with the grid of the antenna elements SE. The arrangement of screws S will then be thinned out such that a screw is provided only for every n-th spacer (n=2, 3, 4 . . . ).

FIGS. 2(*b*) and 2(*c*) differ with respect to the question as the direction from which WAIM layer W is intended to be attached. This can be done both from the rear face (FIG. 2(*b*)) and from the front face of the antenna (FIG. 2(*c*)). In the case of FIG. 2(*b*), screws S are screwed into spacers A through baseplate P. In the case of FIG. 2(*c*), screws S are screwed into baseplate P through WAIM layer W.

With regard to possible reductions in the radar back-scattering cross section (RCS), it is preferable to fit them from the rear, but attachment from the front face has advantages in terms of accessibility, of course.

Figure 3A:
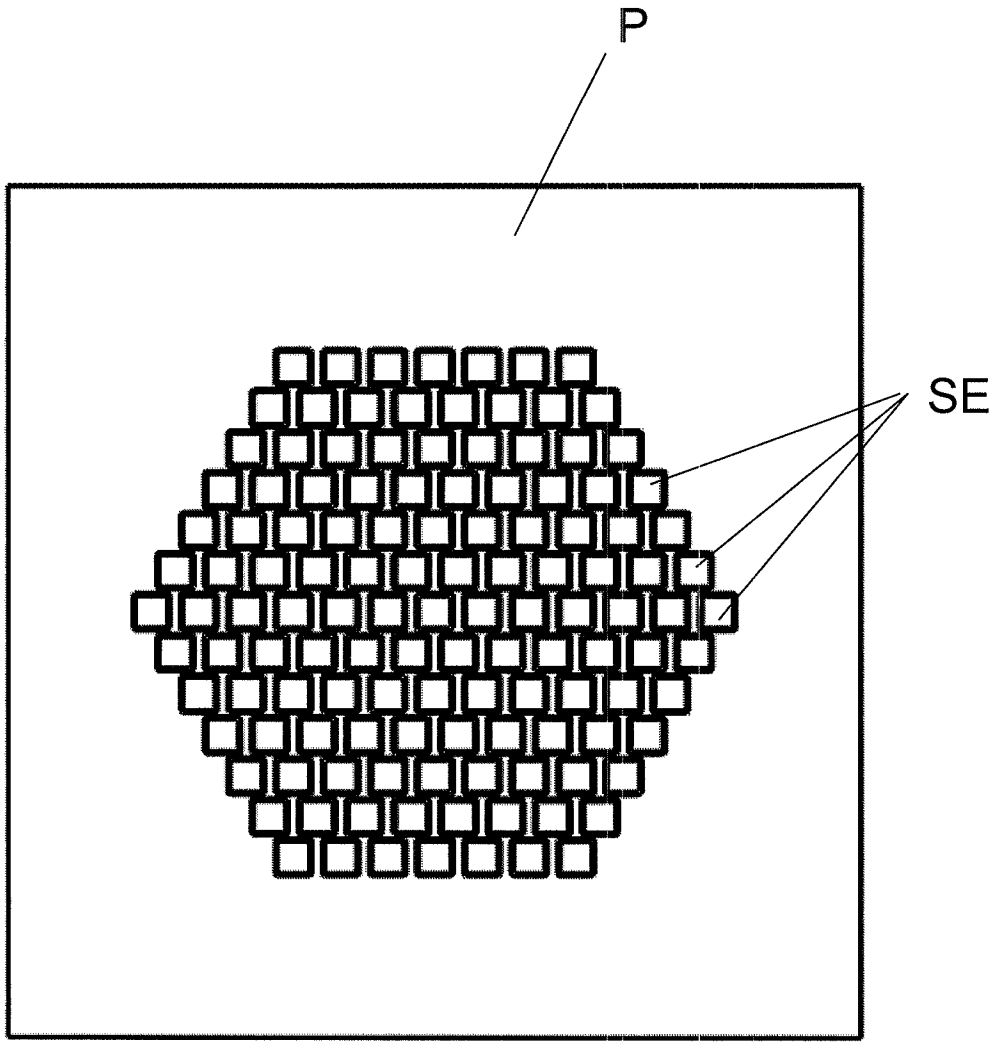
FIG. 3(*a*) illustrates a plan view of an antenna baseplate without WAIM layer.
Figure 3B:
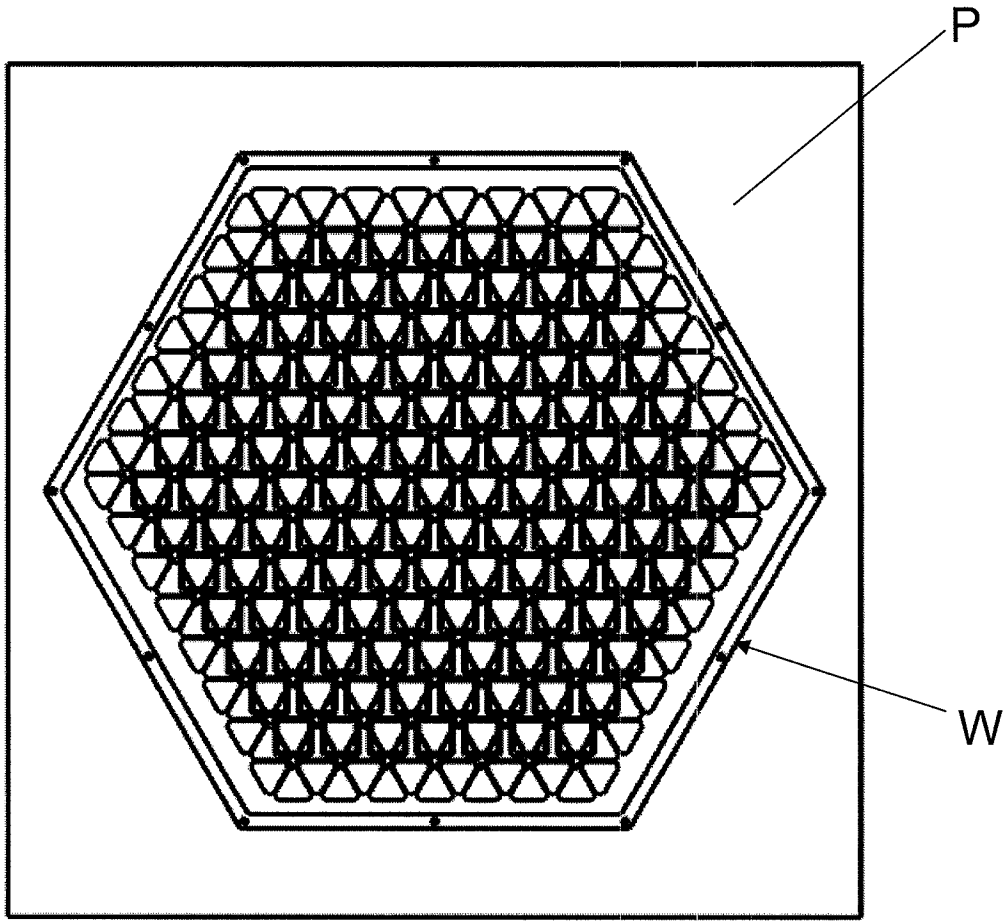
Figure 3C:
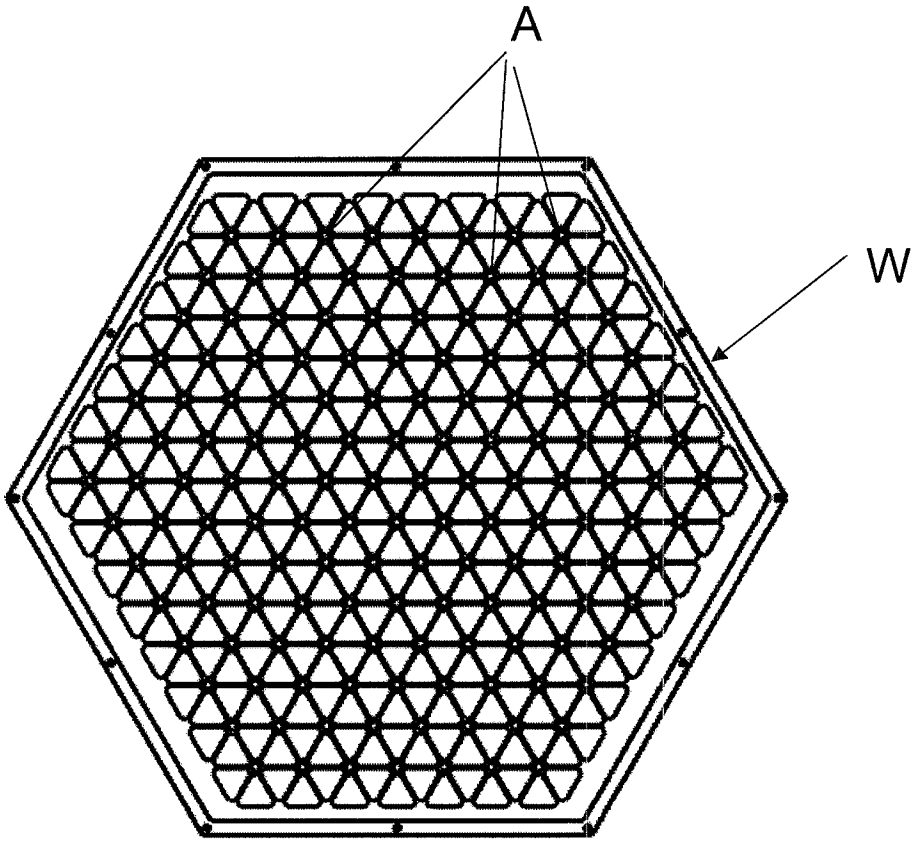

FIG. 3(*a*) shows a plan view of antenna baseplate P with antenna elements SE arranged in a regular grid thereon.

FIG. 3(*c*) shows WAIM layer W matching this with associated spacers A. The grid of spacers A on WAIM layer W in this case corresponds to the grid of antenna elements SE. However, it is to be understood that, while the two grids correspond to each other, it is not necessary that the grid of the spacers A is the same as the grid of the antenna elements SE. In this regard, it can be understood that the grid of spacers A is derived from the grid of antenna elements SE such that, e.g., there is a corresponding spacer only for every n-th antenna element, where n=2, 3, 4, etc.

In FIG. 3(*b*), WAIM layer W (which is illustrated as being transparent) is mounted on antenna baseplate P, and this makes it possible to see the correspondence between the two grids very well.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A phased array antenna comprising:

a plurality of antenna elements;

an antenna baseplate on which the plurality of antenna elements are arranged in a regular grid;

a dielectric wide angle impedance match (WAIM) layer structured and arranged in front of the antenna elements to match impedance for skew angles between 0° and 60°;

wherein the WAIM layer comprises a monolithic material layer from which spacers are machined in a regular grid that corresponds to the grid of the antenna elements, and wherein the spacers are arranged between the antenna elements.

2. The phased array antenna according to claim 1, wherein the grid of the antenna elements is one of square, rectangular or hexagonal.

3. The phased array antenna according to claim 1, wherein the grid of the spacers is not the same as the grid of the antenna elements.

4. The phased array antenna according to claim 3, wherein the grid of the spacers is derived from the grid of the antenna elements such that there is a corresponding spacer only for every n-th antenna element, where n=2, 3, 4, . . . .

5. The phased array antenna according to claim 1, wherein reinforcing ribs are machined from the WAIM layer so that each reinforcing rib connects two adjacent spacers.

6. The phased array antenna according to claim 1, wherein the plurality of spacers are attached to the antenna baseplate by mechanical connectors.

7. The phased array antenna according to claim 6, wherein the mechanical connectors are arranged in a grid that corresponds to the grid of the spacers.

8. The phased array antenna according to claim 7, wherein the grid of the mechanical connectors is not the same as the grid of the spacers.

9. The phased array antenna according to claim 8, wherein the grid of the mechanical connectors is derived from the grid of the spacers so that a corresponding mechanical connector is provided only for every n-th spacer, where n=2, 3, 4, . . . .

10. The phased array antenna according to claim 1, wherein the spacers have a round cross-section.

11. The phased array antenna according to claim 1, wherein reinforcing ribs are machined from the WAIM layer so that the reinforcing ribs are arranged in a triangular configuration with a spacer is located at each vertex of the triangular configuration.

12. The phased array antenna according to claim 1, wherein, via the reinforcing ribs, each spacer is directly connected to at least three other spacers.

13. A method for forming a phased array antenna, comprising:

arranging a plurality of antenna elements on an antenna backplate in an antenna element grid;

forming a dielectric wide angle impedance match (WAIM) layer by forming a plurality of spacers from a monolithic material layer, the plurality of spacers being arranged in a regular grid corresponding to the antenna element grid;

positioning the WAIM layer in front of the antenna elements to match impedance for skew angles between 0° and 60°, wherein the plurality of spacers is arranged between the antenna elements.

14. The method according to claim 13, wherein the grid formed by the plurality of antenna elements is one of square, rectangular or hexagonal.

15. The method according to claim 13, wherein the grid of the spacers is not the same as the grid of the antenna elements.

16. The method according to claim 15, wherein the grid of the spacers is derived from the grid of the antenna elements such that there is a corresponding spacer only for every n-th antenna element, where n=2, 3, 4, . . . .

17. The method according to claim 13, further comprising machining reinforcing ribs in the WAIM layer so that each reinforcing rib connects two adjacent spacers.

18. The method according to claim 13, further comprising attaching the plurality of spacers to the antenna baseplate with mechanical connectors.

19. The method according to claim 18, wherein the mechanical connectors are arranged in a grid that corresponds to the grid of the spacers.

20. The method according to claim 19, wherein the grid of the mechanical connectors is not the same as the grid of the spacers.

21. The method according to claim 20, wherein the grid of the mechanical connectors is derived from the grid of the spacers so that a corresponding mechanical connector is provided only for every n-th spacer, where n=2, 3, 4, . . . .

22. The method according to claim 13, wherein the spacers are formed to have a round cross-section.

23. The method according to claim 13, further comprising machining reinforcing ribs from the WAIM layer so that the reinforcing ribs are arranged in a triangular configuration with a spacer is located at each vertex of the triangular configuration.

24. The method according to claim 13, wherein, via the reinforcing ribs, each spacer is directly connected to at least three other spacers.

* * * * *